US008013885B2

(12) United States Patent
Kohira et al.

(10) Patent No.: US 8,013,885 B2
(45) Date of Patent: Sep. 6, 2011

(54) PRINTER AND RECORDING METHOD

(75) Inventors: Hiroyuki Kohira, Chiba (JP); Norimitsu Sanbongi, Chiba (JP)

(73) Assignee: Seiko Instruments Inc. (JP)

( * ) Notice: Subject to any disclaimer, the term of this patent is extended or adjusted under 35 U.S.C. 154(b) by 1168 days.

(21) Appl. No.: 11/643,412

(22) Filed: Dec. 21, 2006

(65) Prior Publication Data

US 2007/0159519 A1 Jul. 12, 2007

(30) Foreign Application Priority Data

Jan. 11, 2006 (JP) ..... 2006-003976

(51) Int. Cl.
*B41J 2/325* (2006.01)

(52) U.S. Cl. ..... 347/218; 347/104; 347/16

(58) Field of Classification Search ..... 347/104, 347/16, 218
See application file for complete search history.

(56) References Cited

U.S. PATENT DOCUMENTS 6,250,754 B1 * 6/2001 Bortolotti ..... 347/104
6,388,692 B1 5/2002 Iwata et al.
7,722,180 B2 * 5/2010 Mashima ..... 347/104
2004/0066448 A1 * 4/2004 Hoshino et al. ..... 347/220
2005/0276649 A1 12/2005 Min
2006/0082638 A1 4/2006 Sanbongi et al.
2008/0179308 A1 * 7/2008 Kohira ..... 219/216

FOREIGN PATENT DOCUMENTS

EP 1484184 12/2004
JP 2000/063022 2/2000

* cited by examiner

*Primary Examiner* — Matthew Luu
*Assistant Examiner* — Rut Patel
(74) *Attorney, Agent, or Firm* — Adams & Wilks

(57) ABSTRACT

A printer comprises a recording portion with a thermal recording head for recording on a surface of a recording medium and a first conveying mechanism that conveys the recording medium. A thermal activation portion has a thermal activation head for heating another surface of the recording medium and a second conveying mechanism for conveying the recording medium. First and second discharge ports are disposed on a downstream side of the first and second conveying mechanisms, respectively. A pair of conveying rollers is arranged between the recording portion and the first discharge port and between the first discharge port and the thermal activation portion. The conveying rollers convey the recording medium from the recording portion to the first discharge port through normal rotation of the conveying rollers, change a conveyance course of the recording medium conveyed from the recording portion, and convey the recording medium to the thermal activation portion through reverse rotation of the conveying rollers.

7 Claims, 11 Drawing Sheets

PRINTER AND RECORDING METHOD

This application claims priority to Japanese Patent Application No. 2006-003976 filed Jan. 11, 2006, the entire content of which is hereby incorporated by reference.

BACKGROUND OF THE INVENTION

The present invention relates to a printer and a recording method allowing recording on one side of a recording medium and heating of a heat-sensitive adhesive layer on the other side thereof to develop adhesiveness.

Conventionally, there has been put into practical use a heat-sensitive adhesive sheet having a heat-sensitive adhesive layer adapted to develop adhesiveness by being heated. Such the heat-sensitive adhesive sheet is advantageous, for example, in that the sheet is easy to handle since the sheet exhibits no adhesiveness prior to heating and that the sheet involves no industrial waste since the sheet requires no separation sheet. To develop the adhesion force of the heat-sensitive adhesive layer of such the heat-sensitive adhesive sheet, heating is generally effected by using a thermal head used as the recording head of a thermal printer. When a heat-sensitive recordable layer is provided on the side of a heat-sensitive adhesive sheet which is opposite to the heat-sensitive adhesive layer, it is possible to perform recording and thermal activation by using a similar thermal head.

There has been developed a printer which records desired characters, numbers, images, etc. on the recordable layer of such the heat-sensitive adhesive sheet, cuts the sheet in predetermined lengths, and develops adhesiveness, in the heat-sensitive adhesive layer to produce adhesive labels that are to be affixed, for example, to goods to display prices, trade names, etc. Such the printer includes a recording portion for recording desired characters, numbers, symbols, images, etc. on a recordable layer, and a thermal activation portion for thermally activating a heat-sensitive adhesive layer to develop adhesiveness, and is further equipped with a conveying mechanism for conveying a heat-sensitive adhesive sheet and a cutter portion for cutting the heat-sensitive adhesive sheet in a predetermined length into label-like forms. The recording portion and the thermal activation portion are equipped with thermal heads of substantially the same construction, and there are arranged platen rollers respectively opposed to the thermal heads and adapted to support and convey the heat-sensitive adhesive sheet.

Further, a related art proposes a printer which can use, as the recording medium, both the heat-sensitive adhesive sheet as described above and a so-called ordinary label having a non-heat-sensitive adhesive layer covered with a separation sheet. As schematically shown in FIG. 11, in the printer, there are linearly arranged a recording portion 100, a cutter portion 101, a guide portion 102, and a thermal activation portion 103.

According to the related art, when effecting recording and thermal activation on a heat-sensitive adhesive seat 104, a recordable layer is heated by a recording thermal head 105 of the recording portion 100 to perform recording; then, a predetermined sag condition is attained in the guide portion 102, and the heat-sensitive adhesive sheet 104 is cut at a predetermined position by the cutter portion 101. In the thermal activation portion 103, the sag condition in the guide portion 102 is utilized, whereby the heat-sensitive adhesive layer is thermally activated by a heat activation thermal head 106 without stopping the advancement of the heat-sensitive adhesive sheet 104 before the heat-sensitive adhesive sheet is discharged through a discharge port 107.

In the printer, when only ordinary label recording is performed, the recordable layer is heated by the recording thermal head 105 of the recording portion 100 to perform recording, and then the ordinary label is cut at a predetermined position by the cutter portion 101 and passed through the guide portion 102 and the thermal activation portion 103 to be discharged through the discharge port 107. At this time, no partial difference in speed is generated in the ordinary label, and no sag as shown in FIG. 11 is generated in the guide portion 102, with the thermal activation thermal head 106 not being driven. In this way, the printer as disclosed in the related art can handle both the heat-sensitive adhesive sheet 104 and the ordinary sheet.

In the printer disclosed in the related art, the recording portion 100 and the thermal activation portion 103 are arranged linearly. Thus, the recording medium (ordinary label) passes the thermal activation portion 103, which is not to be used in the case of an ordinary label, so that a waste of time is involved from the supply of the recording medium to the discharge thereof through the discharge port 107.

Further, when the heat-sensitive adhesive sheet 104 is used as the recording medium, a portion (fragment) of the heat-sensitive adhesive layer having developed adhesiveness through thermal activation may adhere to and remain on the surface of the thermal activation thermal head 106; the fragment of the heat-sensitive layer thus adhering to and remaining on the surface of the thermal activation thermal head 106 may re-adhere to an ordinary label to be supplied afterwards as the recording medium. As a result, the separation sheet or the like of the ordinary label is endowed with unintended adhesiveness, and the handling of the label may become rather difficult.

Further, when an ordinary label is supplied as the recording medium, if there is some remaining heat in the thermal activation thermal head 106, or the thermal activation thermal head 106 is erroneously driven through an operation error, an error in the detection of the kind of recording medium, etc., unnecessary heat is applied to the separation sheet or the like of the ordinary label, which makes the handling of the sheet rather difficult and involves a danger of causing the user to suffer a burn.

It is accordingly an object of the present invention to provide a printer and a recording method allowing handling of both a recording medium both sides of which are to be heated and a recording medium only one side of which is to be heated, and making it possible, especially in the latter case, to prevent a waste of processing time and to avoid unintended imparting of adhesiveness or overheating.

SUMMARY OF THE INVENTION

According to the present invention, a printer includes: a recording portion including a recording head for performing recording on one side of a recording medium and a conveying mechanism for the recording medium; a thermal activation portion arranged at a position off a course of the recording medium conveyed by the conveying mechanism of the recording portion and including a thermal activation head adapted to heat the other side of the recording medium and a conveying mechanism for the recording medium; a first discharge port provided on a downstream side of the course of the recording medium conveyed by the conveying mechanism of the recording portion; a second discharge port provided on the downstream side of the course of the recording medium conveyed by the conveying mechanism of the thermal activation portion; and a conveying roller arranged between the recording portion and the first discharge port, capable of conveying the recording medium from the recording portion to the first discharge port through normal rotation, and capable of changing the course of the recording medium conveyed from the recording portion and conveying the recording medium to the thermal activation portion through reverse rotation.

With this construction, it is possible to effect switching between a case in which the recording medium is caused to advance straight from the recording portion to the first discharge port through the operation of the conveying roller and a case in which the recording medium from the recording portion is changed in course and guided to the thermal activation portion to be discharged through the second discharge port after thermal activation.

To be more specific, a control device is preferably provided which performs control as follows: when there is supplied a recording medium having on one side a recording surface on which recording is to be performed and on the other side a heat-sensitive adhesive layer, the conveying roller is caused to make normal rotation until the trailing end portion of the recording medium on the recording surface of which recording has been performed reaches the conveying roller, and the conveying roller is caused to start reverse rotation in the state in which the trailing end portion of the recording medium is nipped; and when there is supplied a recording medium having on one side a recording surface on which recording is to be performed and requiring no heating of the other side, the conveying roller is caused to make normal rotation until the recording medium on the recording surface of which recording has been performed is discharged through the first discharge port.

With this arrangement, it is possible to perform minimum requisite processing on a recording medium according to the kind of recording medium and to discharge the recording medium after conveying the recording medium through as short a distance as possible.

The thermal activation head develops adhesiveness by heating the heat-sensitive adhesive layer of a recording medium changed in course and conveyed through reverse rotation of the conveying roller, and the conveying mechanism of the thermal activation portion may discharge the recording medium through the second discharge port.

The recording medium having on the one side the recording surface on which recording is to be performed and requiring no heating of the other side thereof may be a recording sheet provided with no adhesive layer or an ordinary label provided with an adhesive layer which is covered with a separation sheet.

When the recording head of the recording portion and the thermal activation head of the thermal activation portion are thermal heads, the conveying mechanism of the recording portion may be a platen roller for recording, and the conveying mechanism of the thermal activation portion may be a platen roller for thermal activation.

It is also possible to provide on a downstream side of the conveying roller a temporary stocking portion capable of temporarily retaining a recording medium on the one side of which recording has been performed. In this case, the temporary stocking portion may be one which temporarily retains the recording medium prior to its conveyance to the thermal activation portion through reverse rotation of the conveying roller and into which the recording medium discharged through the first discharge port through normal rotation of the conveying roller is not introduced.

Alternatively, it is possible to detachably and interchangeably mount on the downstream side of the conveying roller a temporary stocking portion capable of temporarily retaining the recording medium prior to its conveyance to the thermal activation portion through reverse rotation of the conveying roller, and a discharge guide for guiding the recording medium discharged through the first discharge port through normal rotation of the conveying roller.

It is also possible to adopt a construction in which the thermal activation portion and the second discharge port are provided in a unit detachable with respect to the casing of the printer and in which the unit can be detached from the casing when the recording medium is discharged through the first discharge port.

According to the present invention, a recording method uses a printer including: a recording portion including a recording head for performing recording on one side of a recording medium and a conveying mechanism for the recording medium; a thermal activation portion arranged at a position off a course of the recording medium conveyed by the conveying mechanism of the recording portion and including a thermal activation head adapted to heat the other side of the recording medium and a conveying mechanism for the recording medium; a first discharge port provided on a downstream side of the course of the recording medium conveyed by the conveying mechanism of the recording portion; a second discharge port provided on the downstream side of the course of the recording medium conveyed by the conveying mechanism of the thermal activation portion; and a conveying roller arranged between the recording portion and the first discharge port, and in the recording method, when recording is to be performed on one side of the recording medium and thermal activation is to be effected on the other side thereof, the following steps are executed: a step of performing recording on the one side of the recording medium by the recording head and conveying the recording medium by the conveying mechanism of the recording portion and the conveying roller until a trailing end portion of the recording medium reaches the conveying roller; a step of conveying the recording medium toward the thermal activation portion through reverse rotation of the conveying roller in a state in which the conveying roller nips the trailing end portion of the recording medium; and a step of heating the other side of the recording medium conveyed through the reverse rotation of the conveying roller by the thermal activation head and conveying the recording medium by the conveying mechanism of the thermal activation portion to discharge the recording medium through the second discharge port, and when recording is to be performed on one side of the recording medium and no heating is to be performed on the other side thereof, there is executed a step of performing recording on the one side of the recording medium by the recording head and conveying the recording medium by the conveying mechanism of the recording portion and the conveying roller to discharge the recording medium through the first discharge port.

In the case where recording is performed on one side of the recording medium and in which thermal activation is effected on the other side of the same, it is possible to temporarily retain, by the temporary stocking portion provided on the downstream side of the conveying roller, the recording medium prior to its conveyance to the thermal activation portion through reverse rotation of the conveying roller.

In the case where the thermal activation portion and the second discharge port are provided in a unit detachable with respect to the casing of a printer and in which the recording medium is discharged through the first discharge port, the unit may be detached from the casing in advance.

According to the present invention, in the case of the recording medium on the one side of which recording is to be performed and on the other side of which heating is to be effected, it is possible to efficiently perform processing on both sides, conveying the recording medium smoothly and discharging it through the second discharge port. On the other hand, in the case of a recording medium with which it is only necessary to perform recording on one side, it is possible to perform recording solely on one side and to smoothly discharge the recording medium through the first discharge port without causing the recording medium to pass through the thermal activation portion. In the latter case, in particular, it is possible to prevent a waste of processing time and to avoid unintended imparting of adhesiveness and overheating.

DETAILED DESCRIPTION OF THE INVENTION

In the following, an embodiment of the present invention will be described with reference to the drawings.

Figure 1:
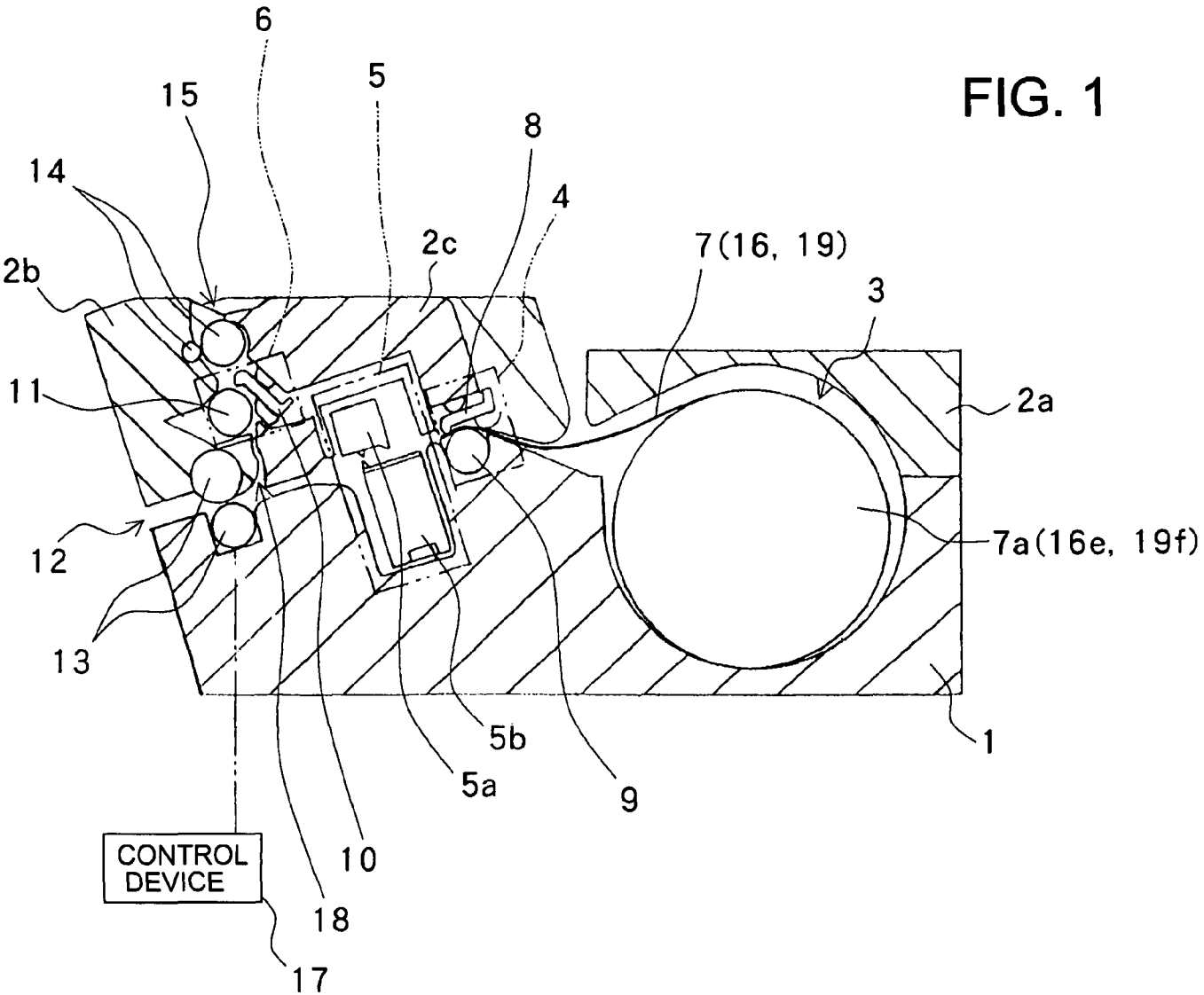
FIG. 1 is a schematic sectional view of a printer according to the first embodiment of the present invention.

FIG. 1 is a schematic sectional view of a printer according to the present invention. The printer of the present invention has a casing composed of a lower frame 1 and upper frames 2*a*, 2*b*, and 2*c*; inside the casing, there are provided a roll body accommodating portion 3, a recording portion 4, a cutter portion 5, and a thermal activation portion 6. The recording portion 4 and the cutter portion 5 are arranged linearly, whereas the thermal activation portion 6 is arranged in an upper position on the downstream side of the cutter portion 5.

The roll body accommodating portion 3 rotatably retains a roll body 7*a* of a recording medium 7. In the drawings, the recording medium 7 and the roll body 7*a* generally refer to a heat-sensitive adhesive sheet 16 and an ordinary label 19 and roll bodies 16*e* and 19*f* thereof.

The recording portion 4 is composed of a recording thermal head 8 having a plurality of heat generating elements consisting of relatively small resistors arranged in the width direction (the direction perpendicular to the plane of FIG. 1) so that dot recording can be performed, and a recording platen roller 9 held in press contact with the recording thermal head 8. The recording thermal head 8 is situated so as to come into contact with a recordable layer 16*d* or 19*d* (see FIG. 2 or 8) of the recording medium 7 supplied from the roll body accommodating portion 3, and the recording platen roller 9, which is a conveying mechanism, is held in press contact with the recording thermal head 8. The recording thermal head 8 is of the same construction as the recording head of a well-known thermal printer; for example, a protecting layer of crystalline glass is provided on the surface of a plurality of heat generating resistors formed on a ceramic substrate.

The cutter portion 5 serves to cut in a predetermined length the recording medium 7 on which recording has been performed by the recording portion 4 to thereby prepare label-like sheets; it is composed of a pair of cutter members 5*a* and 5*b*, etc. The cutter members 5*a* and 5*b* are supported by a support member (not shown).

The thermal activation portion 6 is provided at an upper position on the downstream side of the cutter portion 5. That is, the thermal activation portion 6 is at a position off the course of the recording medium 7 passing the recording portion 4 and the cutter portion 5.

The thermal activation portion 6 has a thermal activation thermal head 10 and a thermal activation platen roller 11. The thermal activation thermal head 10 is of the same construction as the recording thermal head 8. In this construction, heating is effected by using a large number of small heat generating elements (heat generating resistors), so that, as compared with the construction in which heating is effected by using a single (or a very small number of) large heat generating element, it is advantageously easier to make the temperature distribution uniform over a wide range. When the recording medium 7 is a heat-sensitive adhesive sheet 16 described below, the thermal activation thermal head 10 is situated so as to be in contact with the heat-sensitive adhesive layer 16*a* (see FIG. 2) thereof, and the thermal activation platen roller 11, which is a conveying mechanism, is held in press contact with the thermal activation thermal head 10.

A first discharge port 12 is provided on the downstream side of the cutter portion 5, and a pair of conveying rollers 13 is arranged between the cutter portion 5 and the first discharge port 12. Thus, the recording portion 4, the cutter portion 5, the pair of conveying rollers 13, and the first discharge port 12 are arranged linearly in a row. Although not described in detail, one of the pair of conveying rollers 13 is a driving roller, and the other is a driven roller. The driving roller is connected to a control device 17, and is driven so as to selectively make normal rotation and reverse rotation. While, in this embodiment, the control device 17 is connected to the lower conveying roller 13, it is also possible for the control device 17 to be connected to the upper conveying roller 13. Further, although not shown in the drawing, the connecting device 17 may also be connected to the recording thermal head 8 and the recording platen roller 9, the thermal activation thermal head 10 and the thermal activation platen roller 11, and discharge rollers 14 described below, thereby controlling the operations of all of these components.

The thermal activation portion 6 is situated above the linear path formed by the recording portion 4, the cutter portion 5, the pair of conveying rollers 13, and the first discharge port 12. Further, provided above the thermal activation portion 6 are the pair of discharge rollers 14 and a second discharge port 15. There is formed a guide groove 18 by the upper frames 2*b* and 2*c*, in which the recording medium 7 is guided from a position before the pair of conveying rollers 13 to the thermal activation portion 6, and further to a second discharge port 15 through the pair of discharge rollers 14.

In the following, a method of selectively performing recording on a plurality of kinds of recording medium by using the printer constructed as described above will be illustrated with reference to the flowchart of FIG. 3.

Figure 2:
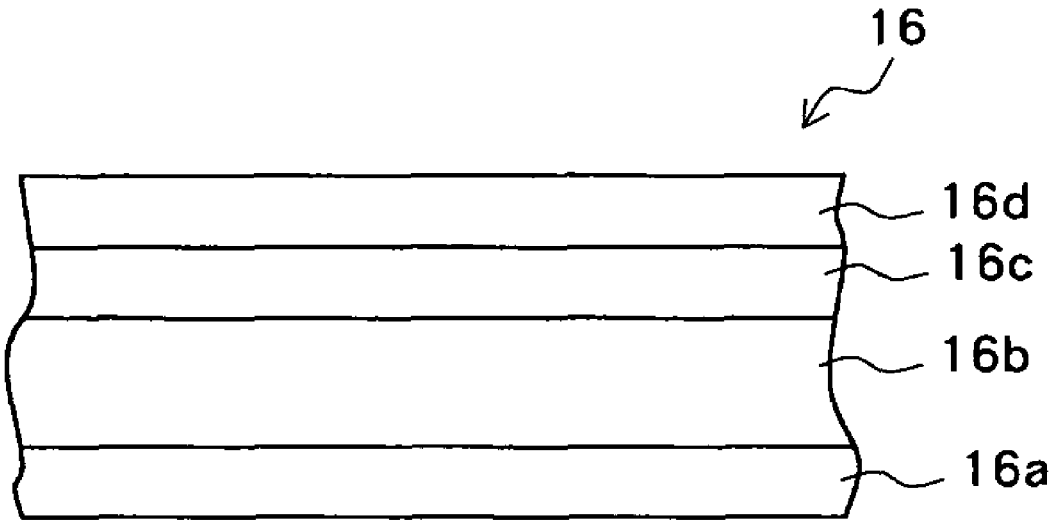
FIG. 2 is an enlarged view of a heat-sensitive adhesive sheet constituting an example of the recording medium.

First, the case in which the heat-sensitive adhesive sheet 16 is used as the recording medium 7 will be described. For example, as shown in FIG. 2, in the heat-sensitive adhesive sheet 16 used in this embodiment, a heat insulating layer 16*c* and a heat-sensitive coloring layer (recordable layer) 16*d* are formed on a front surface (one surface) side of a sheet-like substrate 16*b*, and the heat-sensitive adhesive layer 16*a* is formed on a back surface (the other surface) side thereof. The heat-sensitive adhesive layer 16*a* is formed by applying, drying, and solidifying a heat-sensitive adhesive whose main component is a thermoplastic resin, a solid plastic resin, or the like. However, the heat-sensitive adhesive sheet 16 is not restricted to this construction; it allows various modifications as long as the heat-sensitive adhesive sheet 16 has the heat-sensitive adhesive layer 16*a*. For example, it is also possible to use a heat-sensitive adhesive sheet having no heat insulating layer 16*c* or, although not shown in the drawing, one in which a protective layer or a colored recording layer (a layer on which recording is performed beforehand) is provided on the surface of the recordable layer 16*d* or one in which a thermal coating layer is provided thereon.

A method of manufacturing a desired adhesive label consisting of the heat-sensitive adhesive sheet 16 will be described. First, the roll body 16*e* of the heat-sensitive adhesive sheet 16 is accommodated in the roll body accommodating portion 3. Then, as shown in FIG. 1, the heat-sensitive adhesive sheet 16 drawn out of the roll body 16*e* is inserted and set between the recording thermal head 8 and the recording platen roller 9 of the recording portion 4 (step 31). A recording signal is supplied to the recording thermal head 8, and the plurality of heat generating elements of the recording thermal head 8 are selectively driven with an appropriate timing to generate heat, thereby performing recording on the recordable layer 16*d* of the heat-sensitive adhesive sheet 16. The recording platen roller 9 is driven and rotated in synchronism with the driving of the recording thermal head 8, and the heat-sensitive adhesive sheet 16 is conveyed in a direction crossing the direction in which the heat generating elements of the recording thermal head 8 are arranged, for example, in a direction perpendicular to the row of heat generating elements. To be more specific, the recording of one line by the recording thermal head 8 and the conveyance of the heat-sensitive adhesive sheet 16 by a predetermined amount (corresponding to one line) by the recording platen roller 9 are alternately repeated, whereby desired characters, numbers, symbols, images, etc. are recorded on the heat-sensitive adhesive sheet 16 (step 32).

Figure 4:
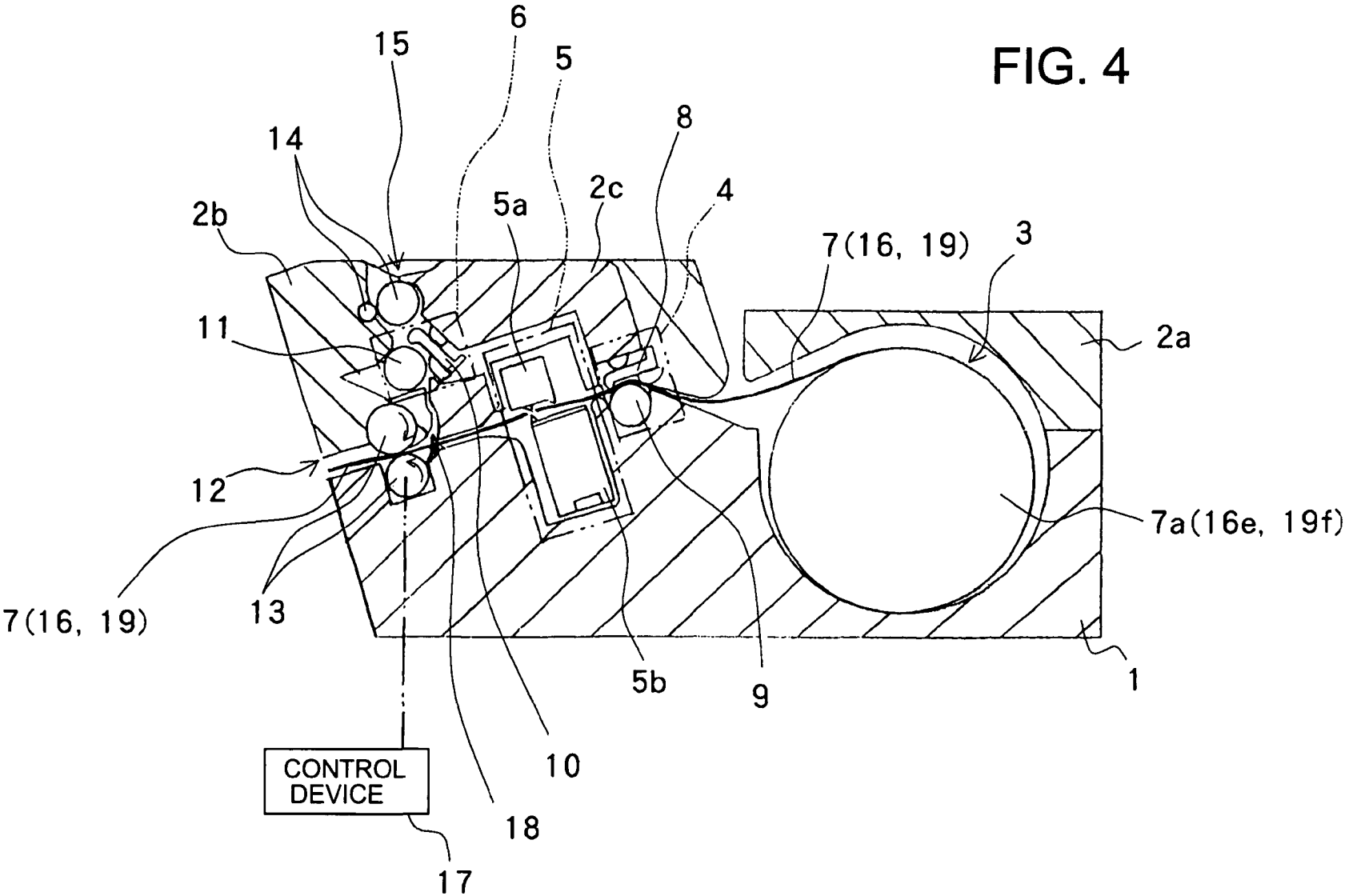
FIG. 4 is a schematic sectional view showing how the recording medium is cut in the printer shown in FIG. 1.

The heat-sensitive adhesive sheet 16 on which recording has been thus performed passes between the cutter members 5*a* and 5*b* of the cutter portion 5. When the leading edge portion of the heat-sensitive adhesive sheet 16 reaches the position of the pair of conveying rollers 13, the conveying rollers 13 rotate, and both the conveying rollers 13 and the recording platen roller 9 cooperate with each other to convey the heat-sensitive adhesive sheet 16 (step 33). Then, when the portion of the heat-sensitive adhesive sheet 16 to be cut reaches the position where the cutter members 5*a* and 5*b* are opposed to each other, the recording platen roller 9 and the conveying rollers 13 are temporarily stopped, and, as shown in FIG. 4, the heat-sensitive adhesive sheet 16 is cut by the cutter members 5*a* and 5*b* (step 34). When the cutting has been completed, the conveying rollers 13 rotate again to further convey the heat-sensitive adhesive sheet 16 of a label-like form, which has undergone recording and cutting (step 35). Soon, the leading end portion of the heat-sensitive adhesive sheet 16 projects out of the printer through the first discharge port 12.

Figure 5:
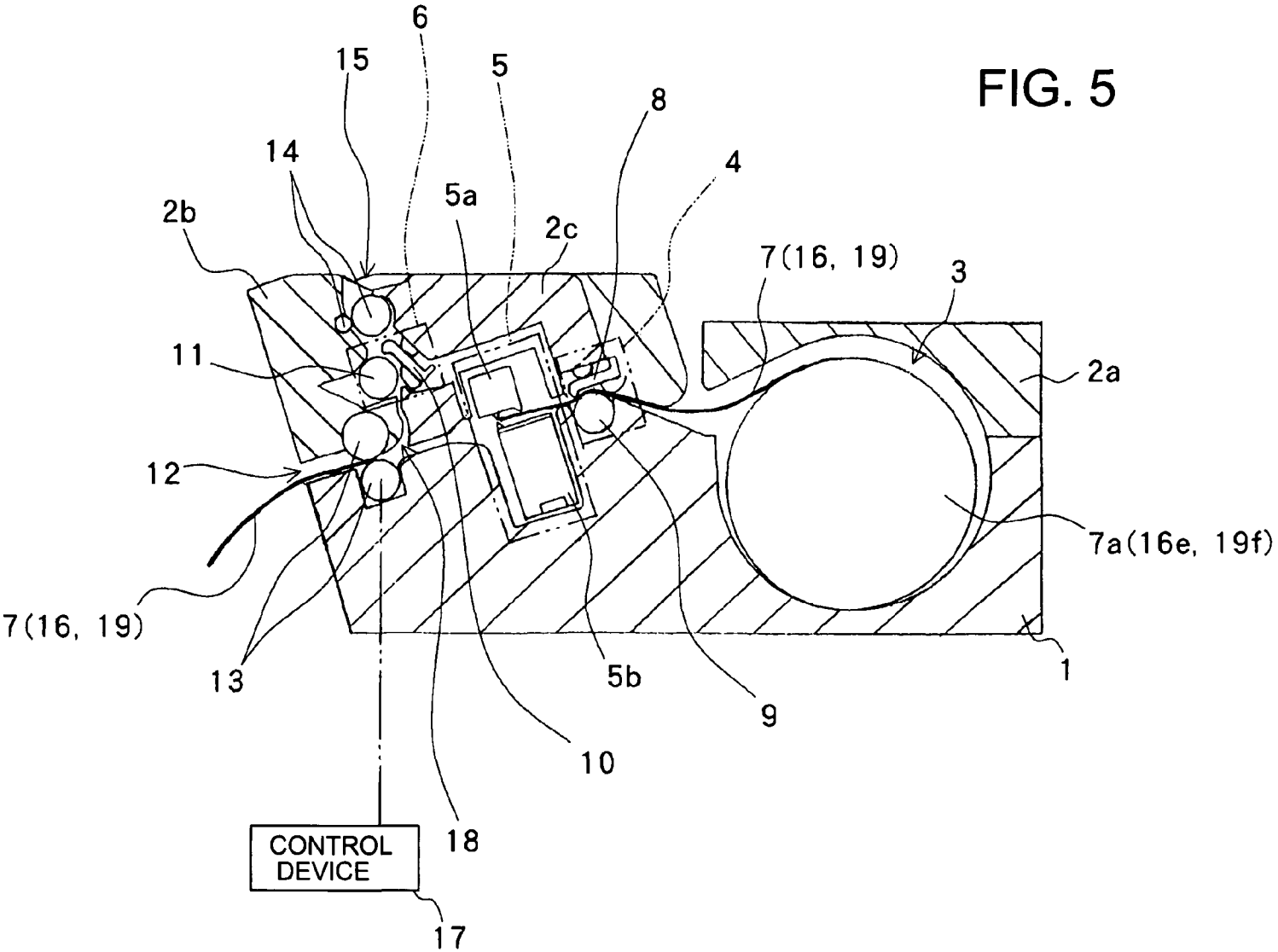
FIG. 5 is a schematic sectional view showing how a pair of conveying rollers nips the trailing end portion of the recording medium in the printer shown in FIG. 1.
Figure 6:
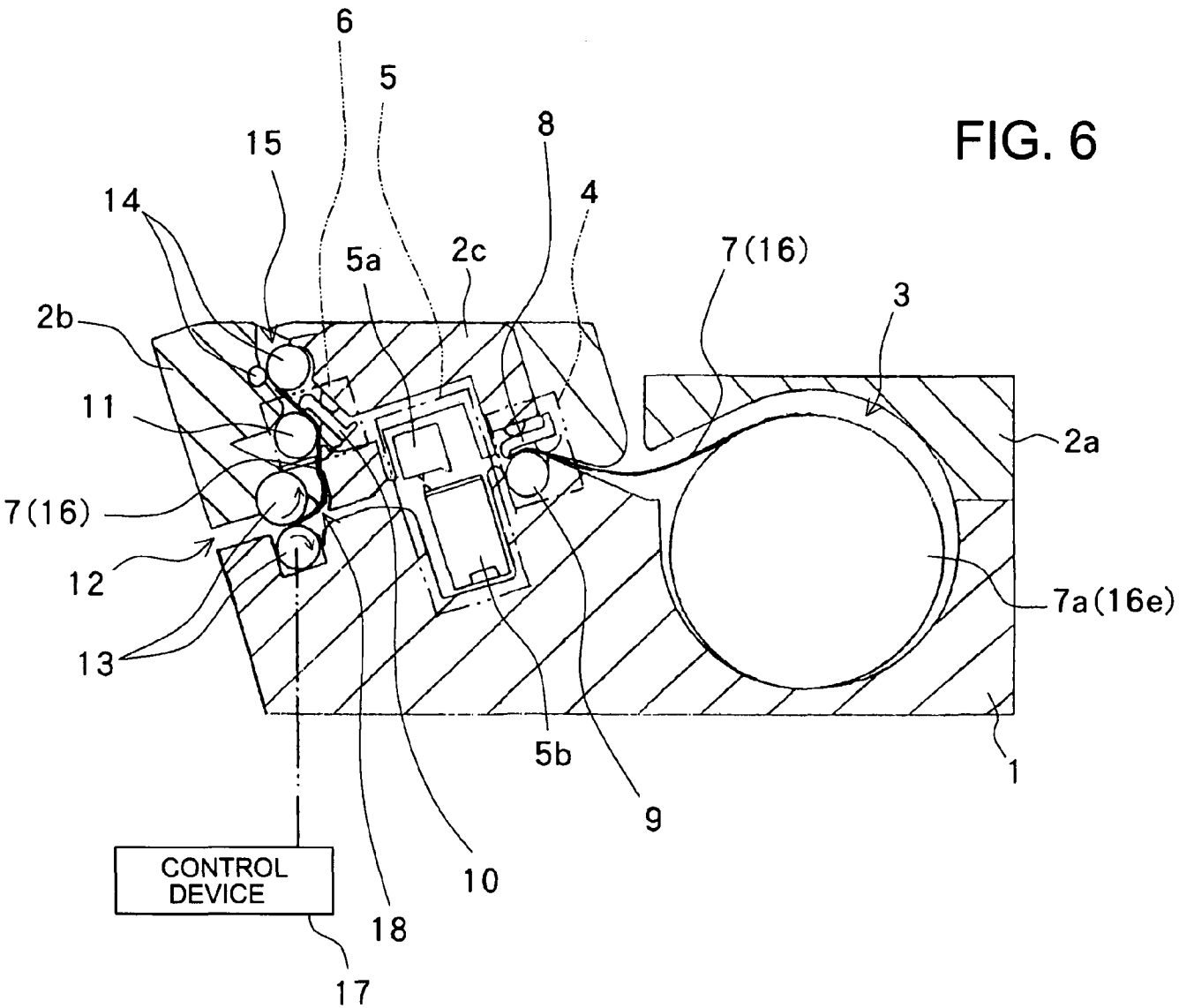
FIG. 6 is a schematic sectional view showing how the recording medium is thermally activated in the printer shown in FIG. 1.

In the case where the heat-sensitive adhesive sheet 16 is used as the recording medium and it is necessary to effect thermal activation on the heat-sensitive adhesive layer 16*a* (step 36), the control device 17 changes the rotating directions of the conveying rollers 13 and starts reverse rotation before the trailing end portion of the heat-sensitive adhesive sheet 16 leaves the pair of conveying rollers 13, that is, in the state in which the trailing end portion is nipped by the pair of conveying rollers 13 as shown in FIG. 5 (step 37). As a result, the label-like heat-sensitive adhesive sheet 16 that has undergone recording and cutting is changed in its course, guided to the guide groove 18, and sent to the thermal activation portion 6, starting with the trailing end portion as shown in FIG. 6. Then, in the thermal activation portion 6, the thermal activation thermal head 10 is driven, with the heat-sensitive adhesive sheet 16 being nipped between the thermal activation thermal head 10 and the thermal activation platen roller 11, whereby the heat-sensitive adhesive layer 16*a* in contact therewith is heated and thermally activated (step 38). At the same time, the thermal activation platen roller 11 is rotated to feed the heat-sensitive adhesive sheet 16, and causes the heat-sensitive adhesive sheet 16 to pass while holding the entire surface of the heat-sensitive adhesive layer 16*a* in contact with the thermal activation thermal head 10.

In the thermal activation portion 6 of this embodiment, the thermal activation thermal head 10 operates and generates heat while the heat-sensitive adhesive sheet 16 is pressed against the thermal activation thermal head 10 by the thermal activation platen roller 11, whereby the heat-sensitive adhesive layer 16*a* in contact therewith is heated and thermally activated. At the same time, the thermal activation platen roller 11 rotates and the heat-sensitive adhesive sheet 16 is conveyed to pass while the entire surface of the heat-sensitive adhesive layer 16*a* is held in contact with the thermal activation thermal head 2, whereby adhesiveness is developed all over the heat-sensitive adhesive layer 16*a* on one side of the heat-sensitive adhesive sheet 16.

Figure 7:
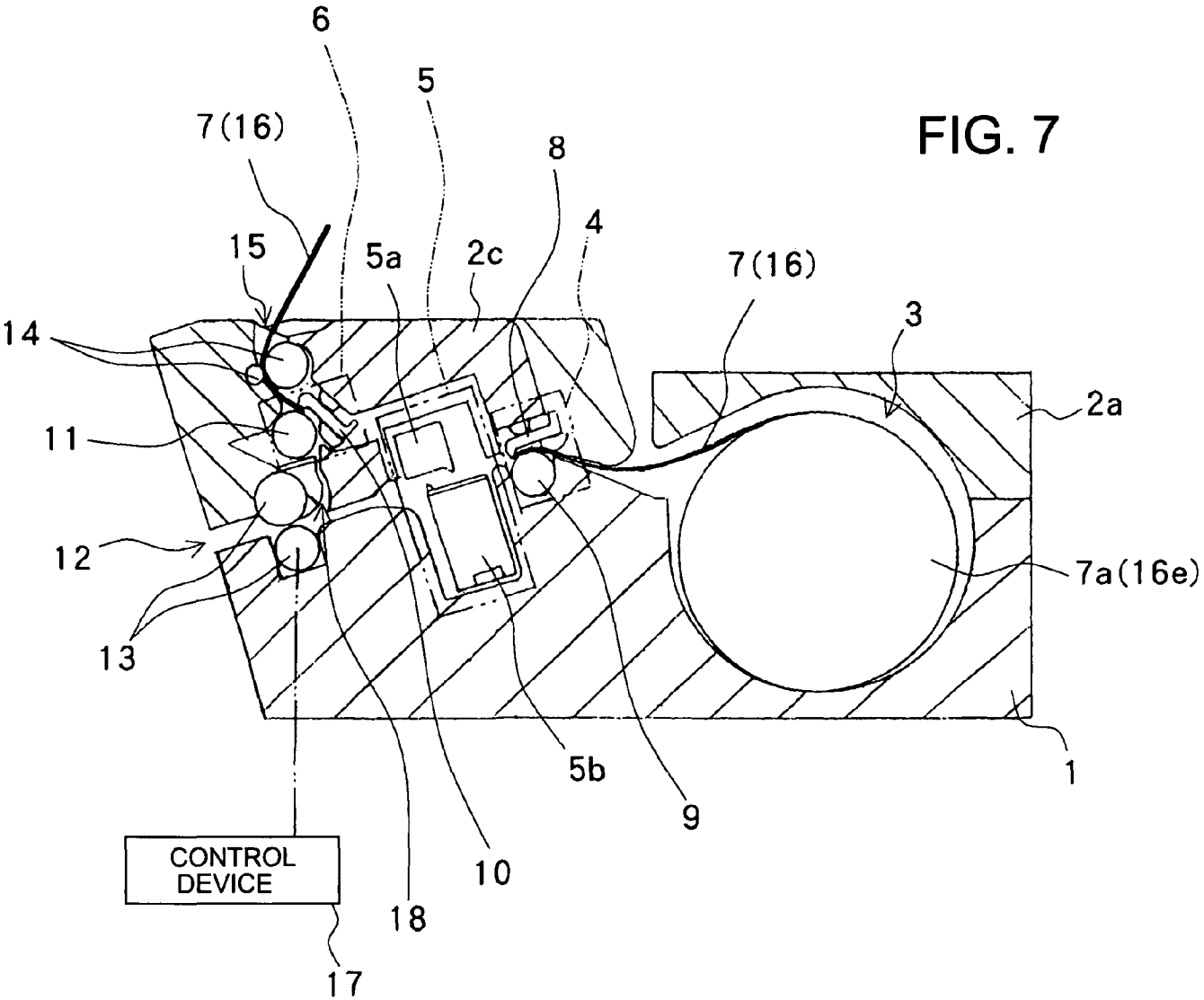
FIG. 7 is a schematic sectional view showing how discharge operation with respect to the thermally activated recording medium is performed in the printer shown in FIG. 1.

In this way, there is produced an adhesive label consisting of the heat-sensitive adhesive sheet 16, on one side of which a desired recording has been performed, on the other side of which adhesiveness has been developed, and which has been cut in a predetermined length. This adhesive label is conveyed by the thermal activation platen roller 11 and the pair of discharge rollers 14, and is discharged to the exterior of the printer through the second discharge port 15 as shown in FIG. 7 (step 39).

In the case where the portion of the heat-sensitive adhesive sheet 16 which has not undergone recording yet has been drawn out to the position of the cutter members 5*a* and 5*b* of the cutter portion 5 (see FIG. 5), the label-like heat-sensitive adhesive sheet 16 that has undergone recording and cutting is sent to the thermal activation portion 6; at the same time, the recording platen roller 9 is caused to make reverse rotation with an appropriate timing, and the portion of the heat-sensitive adhesive sheet 16 which has not undergone recording yet is taken up by the roll body 16*e* again (see FIG. 6). In this way, the printer is made ready for the production of the next adhesive label.

Next, a recording method in a case where a recording medium requiring no thermal activation is processed by the printer of this embodiment will be described. The processes that are the same as those in the method of manufacturing an adhesive label consisting of the above-described heat-sensitive adhesive sheet 16 will be described with reference to the same drawings.

Figure 8:
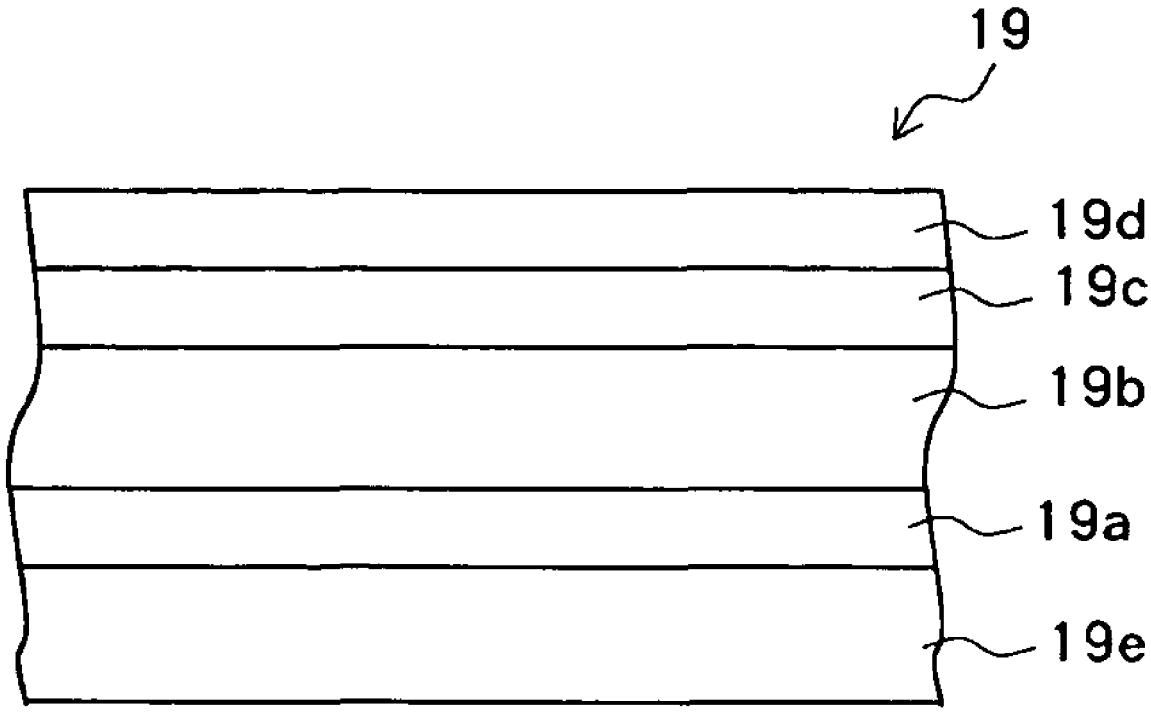
FIG. 8 is an enlarged view of an ordinary label constituting an example of the recording medium.

Examples of the recording medium requiring no thermal activation include a recording sheet having no adhesive layer and a so-called ordinary label 19 provided with a non-heat-sensitive adhesive layer which is covered with a separation sheet. In the following, an example in which the ordinary label 19 is used as the recording medium 7 will be described. As shown in FIG. 8, in the ordinary label 19, a heat-insulating layer 19*c* and heat-sensitive coloring layer (recordable layer) 19*d* are formed on a front surface (one surface) side of the a sheet-like substrate 19*b*, and an adhesive layer 19*a* is formed on a back surface (the other surface) side thereof; further, attached to the adhesive layer 19*a* is a separation sheet (base sheet) 19*e* which covers the adhesive layer 19*a* and which can be easily separated.

As in the case where the heat-sensitive sheet 16 is used as the recording medium 7, the roll body 19*f* of the ordinary label 19 is accommodated in the roll body accommodating portion 3. Then, as shown in FIG. 1, the ordinary label 19 drawn out of the roll body 19*f* is inserted and set between the recording thermal head 8 and the recording platen roller 9 of the recording portion 4 (step 31). The plurality of heat generating elements of the recording thermal head 8 are selectively driven with an appropriate timing to generate heat, performing recording on the recordable layer 19*d* of the ordinary label 19. At the same time, the recording platen roller 9 is driven to rotate, and conveys the ordinary label 19 to the cutter portion 5 side. The recording of one line by the recording thermal head 8 and the conveyance of the ordinary label 19 by a predetermined amount (corresponding to one line) by the recording platen roller 9 are alternately repeated, whereby a desired recording is performed on the ordinary label 19 (step 32).

The ordinary label 19 having thus undergone recording passes the cutter portion 5 to reach the position of the pair of conveying rollers 13, and both the conveying rollers 13 and the recording platen roller 9 cooperate to convey the ordinary label 19 (step 33). When the portion of the ordinary label 19 to be cut reaches the position where the cutter members 5*a* and 5*b* are opposed to each other, the recording platen roller 9 and the conveying rollers 13 are temporarily stopped, and, as shown in FIG. 4, the ordinary label 19 is cut by the cutter members 5*a* and 5*b* (step 34). When the cutting has been completed, the conveying rollers 13 rotate again to further convey the ordinary label 19 that has undergone recording and cutting (step 35).

When the ordinary label 19, which has no heat-sensitive adhesive layer to be thermally activated, is used as the recording medium (step 36), the control device 17 continues the normal rotation for the conveying rollers 13. Thus, from the state in which the ordinary label 19 projects from the first discharge port 12 as shown in FIG. 5, the ordinary label 19 continues to be conveyed before being discharged to the exterior of the printer (step 40).

In this way, a desired recording is performed on one side by the printer of this embodiment, and the ordinary label 19, cut in a predetermined length, is produced. In using the ordinary label 19, the separation sheet 19*e* is peeled off before attachment of the ordinary label.

As described above, in the printer of this embodiment, it is possible to perform recording and thermal activation on the heat-sensitive adhesive sheet 16, and to smoothly discharge the heat-sensitive adhesive sheet 16 to the exterior of the printer through the second discharge port 15; it is also possible to perform recording solely on the ordinary label 19 and to smoothly discharge the ordinary label 19 to the exterior of the printer through the first discharge port 12. In particular, in the latter case, the ordinary label 19 is discharge through the first discharge port 12 without passing the thermal activation portion 6, so that no waste of time is involved. The ordinary label 19 does not come into contact with the thermal activation thermal head 10, so that if a fragment of the heat-sensitive adhesive layer adheres to and remain on the thermal activation thermal head 10, there is no fear of its adhering to the ordinary label 19 again. Further, if there is some residual heat in the thermal activation thermal head 10, or the thermal activation thermal head 10 is erroneously driven, no unnecessary heat is imparted to the ordinary label 19. Further, the ordinary label 19 passes through the linear path formed by the recording portion 4, the cutter portion 5, the pair of conveying rollers 13, and the first discharge port 12 to be discharged, so that the ordinary label 19 is not bent during conveyance; thus, there is no fear of the separation sheet 19*e* being separated within the printer.

Figure 3:
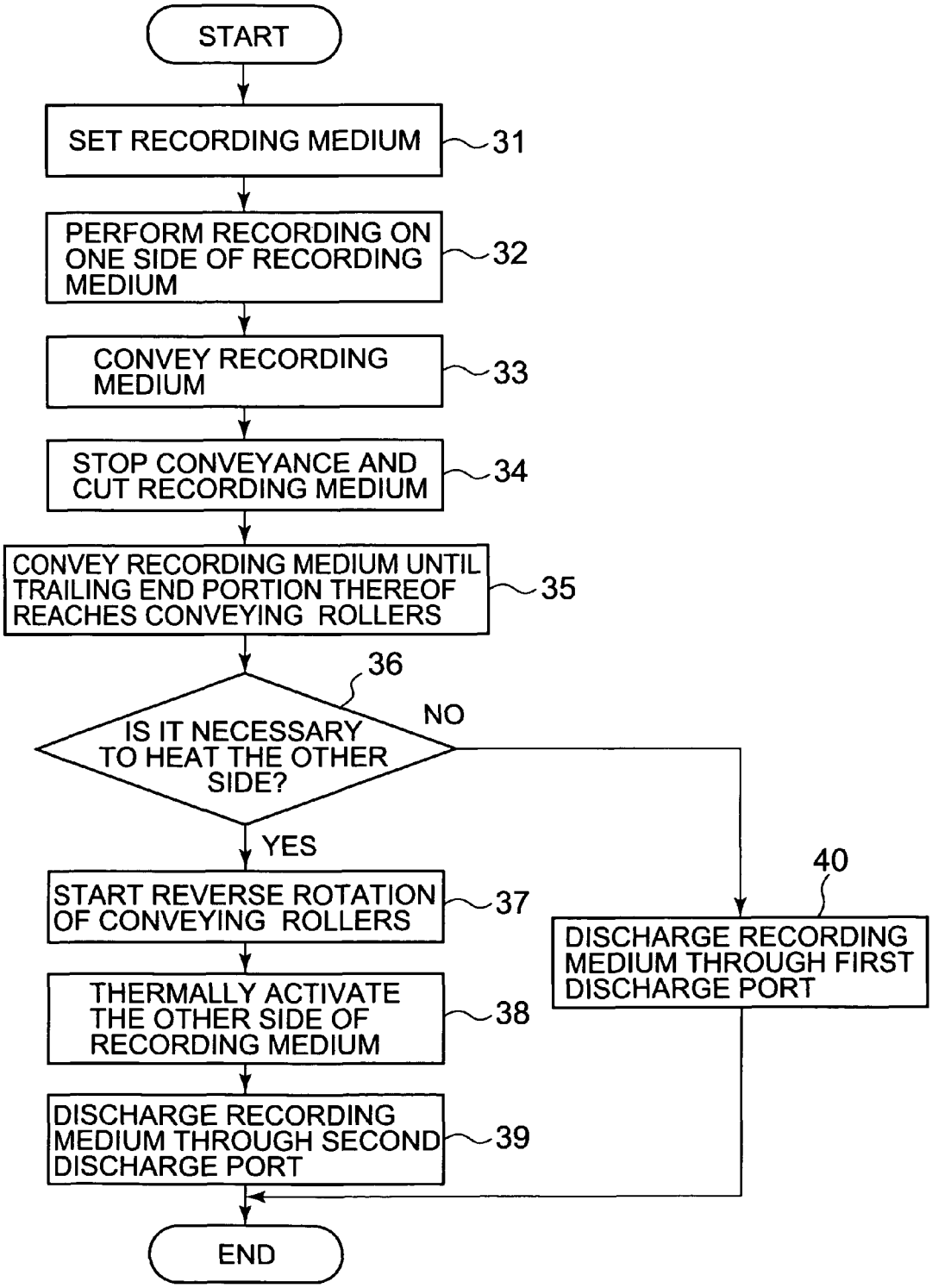
FIG. 3 is a flowchart showing a recording method according to the first embodiment of the present invention.

For the sake of convenience, in the flowchart of FIG. 3, it is checked, in step 36, whether it is necessary to heat the other side of the recording medium or not (whether thermal activation of the heat-sensitive adhesive layer is necessary or not). In reality, however, it is only necessary to perform input and setting on the control device 17 as to whether the heating of the other side is necessary or not prior to the start of the recording operation or when the user sets the recording medium. There is no need to perform any special process for checking after the process of recording on the recording medium.

Next, a second embodiment of the present invention will be described. The components that are the same as those of the first embodiment described above are indicated by the same reference numerals, and a description of such components will be omitted.

Figure 9:
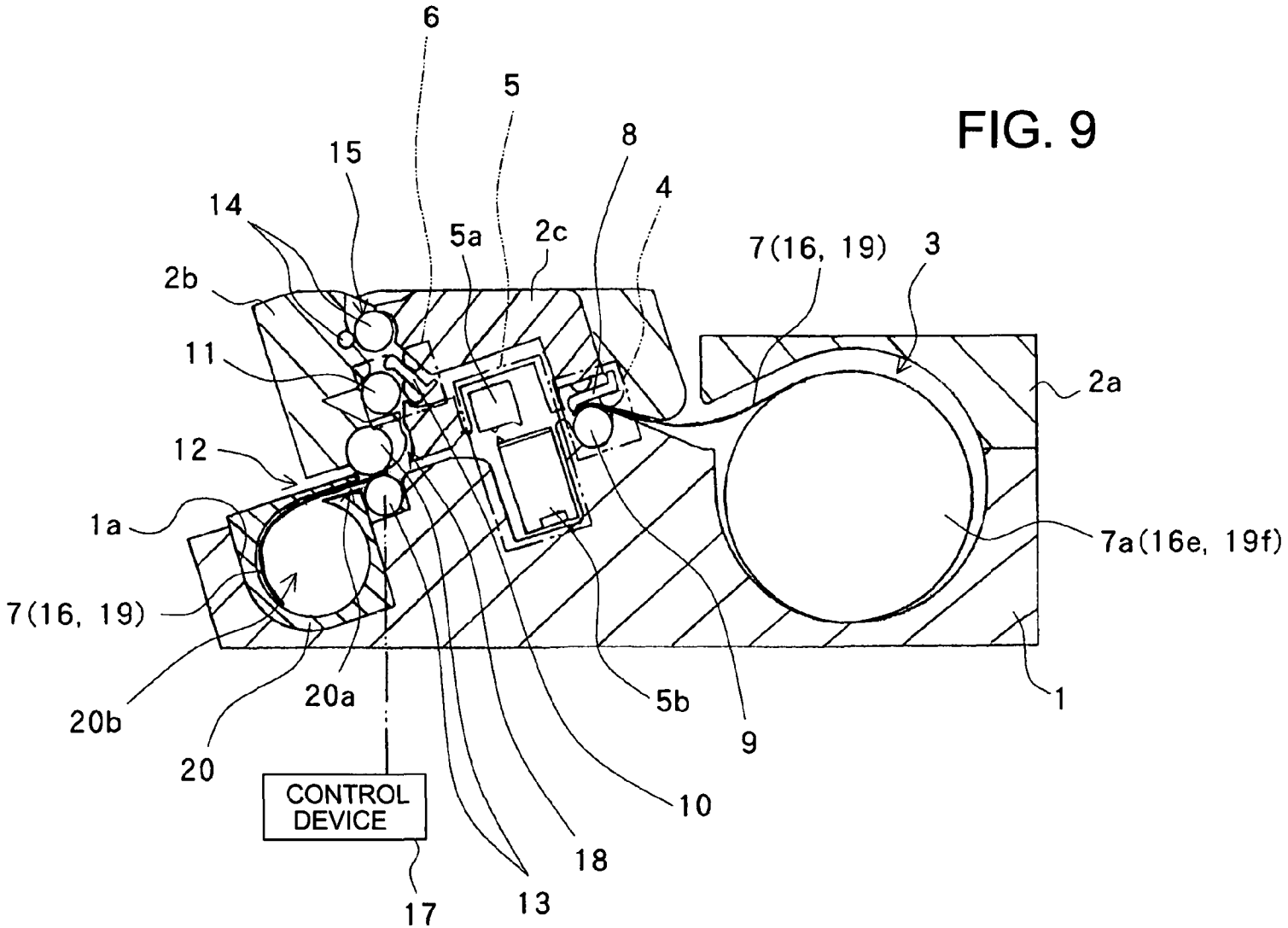
FIG. 9 is a schematic sectional view showing how a pair of conveying rollers nips a heat-sensitive adhesive sheet in a printer according to the second embodiment of the present invention.

As shown in FIG. 9, in this embodiment, a temporary stocking portion 20 is provided between the pair of conveying rollers 13 and the first discharge port 12. The temporary stocking portion 20 is inserted into and retained in a recess 1*a* provided in the lower frame 1. The temporary stocking portion 20 has an inlet 20*a* for smoothly introducing the heat-sensitive adhesive sheet 16, and an accommodating space 20*b* of a round contour for accommodating the heat-sensitive adhesive sheet 16 introduced through the inlet 20*a* while looping the same. In this construction, the portion of the heat-sensitive adhesive sheet 16 which has passed the conveying rollers 13 is introduced through the inlet 20*a* of the temporary stocking portion 20 and accommodated in the accommodating space 20*b*, and does not project into the exterior of the printer from the first discharge port 12. When the control device 17 starts reverse rotation for the pair of conveying rollers 13, the heat-sensitive adhesive sheet 16, which has been accommodated in the accommodating space 20*b*, is drawn out of the accommodating space 20*b* again, and is sent to the thermal activation portion 6 along the guide groove 18.

In this embodiment, the heat-sensitive adhesive sheet 16 does not project into the exterior of the printer from the first discharge port 12 before the heat-sensitive adhesive sheet 16 is sent to the thermal activation portion 6, that is, before the pair of conveying rollers 13 starts reverse rotation. Thus, there is no danger of the user erroneously grabbing the portion projecting into the exterior of the printer from the first discharge port 12 prior to the completion of the adhesive label to tear the heat-sensitive adhesive sheet 16.

In the state shown in FIG. 9, the heat-sensitive adhesive sheet 16 is guided into the accommodating space 20*b* through the inlet 20*a* of the temporary stocking portion 20 through normal rotation of the conveying rollers 13. However, in the case of FIG. 8, in which the ordinary label 19 is used as the recording medium, the ordinary label 19 is not accommodated in the accommodating space 20*b* of the temporary stocking portion 20 through normal rotation of the conveying rollers 13 but must be discharged as it is to the exterior of the printer through the first discharge port 12. In view of this, in this embodiment, when a recording medium requiring no heating on both of the sides thereof, such as the ordinary label 19, is used, a discharge guide 21 is previously installed instead of the temporary stocking portion 20. To be more specific, the temporary stocking portion 20 is extracted from the recess 1*a* of the lower frame 1, and the discharge guide 21 is inserted into the recess 1*a*. When processing the ordinary label 19, the ordinary label 19, on one side of which recording has been performed, is caused to advance on the discharge guide 21 through normal rotation of the conveying rollers 13, and is discharged as it is through the first discharge port 12. In this embodiment, the contour of the lower portion of the temporary stocking portion 20 is the same as the contour of the lower portion of the discharge guide 21; each of those contours is of a configuration adapted to be fit-engaged with the recess 1*a*. Thus, the temporary stocking portion 20 and the discharge guide 21 are easily interchangeable according to the kind of recording medium.

Figure 10:
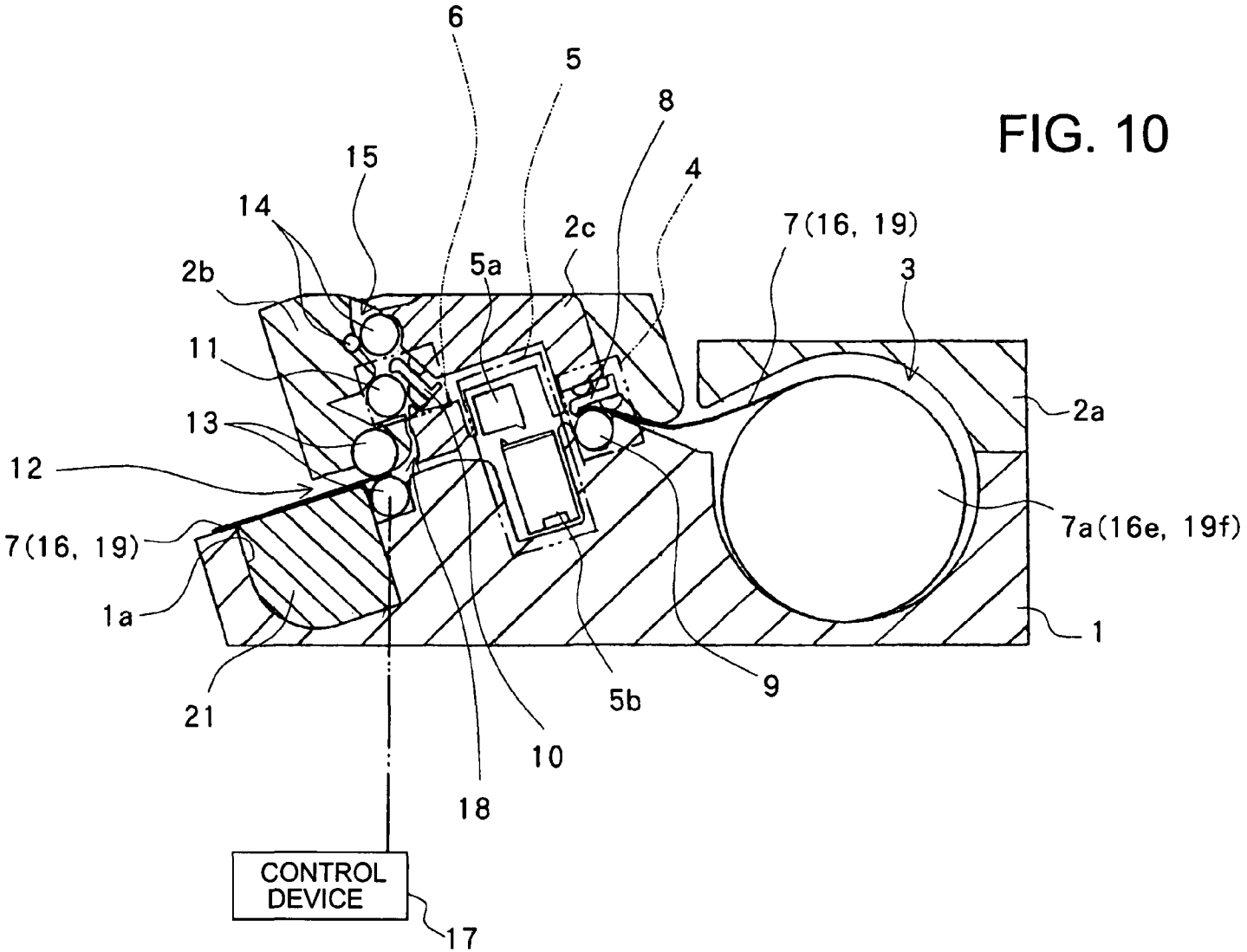
FIG. 10 is a schematic sectional view showing how discharge operation with respect to the ordinary label is performed in the printer of the second embodiment of the present invention.
Figure 11:
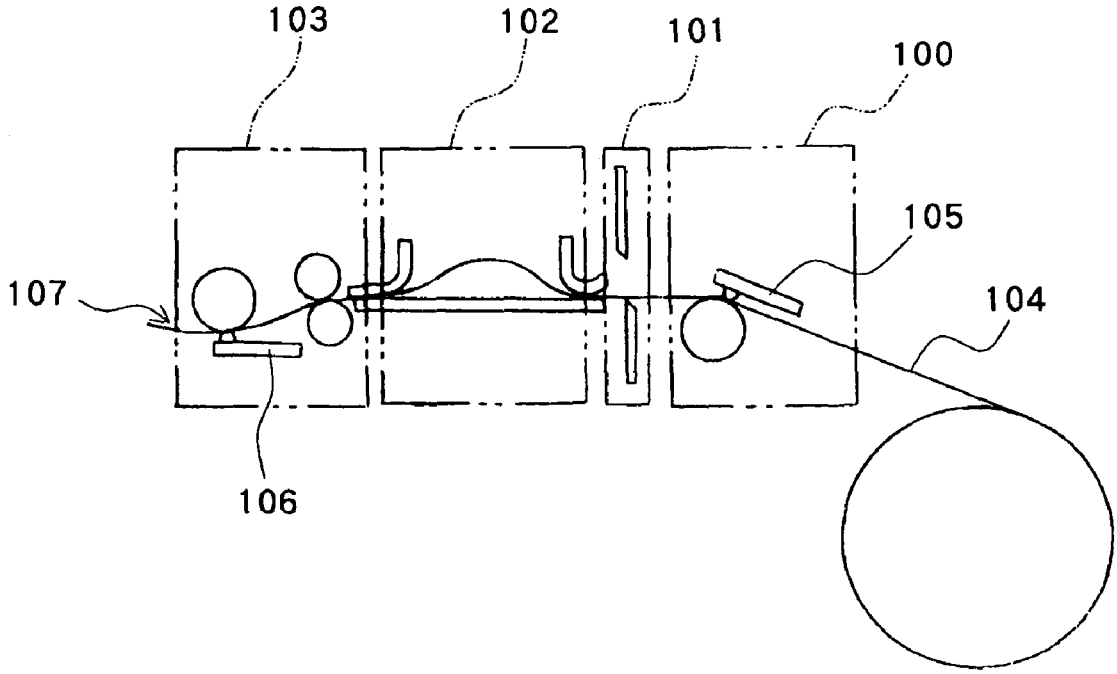
FIG. 11 PRIOR ART
FIG. 11 is a schematic sectional view of a conventional printer.

Although not shown in the drawings, as a modification of the construction shown in FIGS. 9 and 10, a construction is conceivable in which a movable guide member is provided between the temporary stocking portion 20 and the conveying rollers 13. The movable guide member is movable between the position where the recording medium is guided to the inlet 20*a* of the temporary stocking portion 20 and the position where the inlet 20*a* of the temporary stocking portion 20 is closed and where recording medium is guided to the first discharge port 12. Thus, when heating is to be effected on the other side of the recording medium, it is possible to guide the recording medium to the inlet 20*a* of the temporary stocking portion 20 by the movable guide member, and when there is no need to effect heating on the other side of the recording medium, it is possible to move the movable guide member to close the inlet 20*a* of the temporary stocking portion 20 and to guide the recording medium to the first discharge port 12.

In this embodiment, even when the heat-sensitive adhesive sheet 16 is used as the recording medium, when producing an adhesive label larger (longer) than the capacity of the accommodating space 20*b* of the temporary stocking portion, the heat-sensitive adhesive sheet 16 after recording is not accommodated in the accommodating space 20*b* but is caused to project into the exterior of the printer from the second discharge port 15 as in the case of the state shown in FIG. 10. Then, in the state in which the trailing end portion of the heat-sensitive adhesive sheet 16 is nipped by the pair of conveying rollers 13, the conveying rollers 13 are caused to make reverse rotation to convey the heat-sensitive adhesive sheet to the thermal activation portion 6. That is, an operation that is substantially the same as that of the first embodiment is conducted. In this way, it is possible to utilize the size (length) of the label to be produced as the factor for deciding whether the heat-sensitive adhesive sheet 16 is to be accommodated in the accommodating space 20*b* of the temporary stocking portion 20 or not.

As described above, in the printer of the present invention, when it is necessary to perform recording on one side of the recording medium 7 and to effect thermal activation on the other side thereof, the recording medium 7 after the recording is guided to the thermal activation portion 6 and thermally activated before being discharged through the second discharge port 15. On the other hand, when recording is to be performed on one side of the recording medium 7 but there is no need to effect heating on the other side thereof, the recording medium 7 is discharged as it is through the first discharge port 12 and is not caused to pass the thermal activation portion 6.

In the above-mentioned examples of the recording medium 7 requiring no thermal activation include a recording sheet having no adhesive layer and the ordinary label 19. Apart from those, when, while the heat-sensitive adhesive sheet 16 is used, solely recording is to be performed, or when solely recording is previously performed and adhesiveness is to be developed immediately before attachment to another member in actual use, the heat-sensitive adhesive sheet 16 may also be discharged, as described above, through the first discharge port 12 without passing the thermal activation portion 6. When, in actual use, adhesiveness is to be developed immediately before attachment to another member, it is also possible to perform recording on the entire long heat-sensitive adhesive sheet 16 without performing cutting by the cutter portion 5, effecting cutting and thermal activation immediately before attachment.

Conversely, even when a recording sheet having no adhesive layer is used as the recording medium 7, there are cases in which it is desirable to discharge the recording sheet to the exterior of the printer with a predetermined timing after the completion of the recording instead of discharging the recording sheet to the exterior of the printer simultaneously with the recording operation or immediately after the recording. In such cases, as in the case where the heat-sensitive adhesive sheet 16 is treated, it is possible for the pair of conveying rollers 13 to start reverse rotation in the state in which the pair of conveying rollers 13 nip the trailing end portion of the recording sheet after the recording, and to cause the recording sheet to pass the thermal activation portion 6 before discharging the recording sheet to the exterior of the printer through the second discharge port 15. The thermal activation thermal head 10, however, is not driven. This mode of discharge is referred to as a presenter function.

Although not shown in the drawings, when the thermal activation portion 6, the discharge roller 14, and the second discharge port 15 are provided as a unit allowed to be integrally detached, it is possible to previously detach this unit when there is no need to heat the other side of the recording medium 7.

While in the example described above, a pair of conveying rollers 13 is used, this should not be construed restrictively; it is also possible to adopt a construction in which an opposing member of a configuration other than that of a roller is opposed to a single conveying roller 13. Further, the recording medium 7 may have on one side thereof a recording surface other than a heat-sensitive coloring layer (recordable layer), that is, a recording surface on which recording is effected not by heating but by some other method. In this case, the recording portion 4 may have, instead of the recording thermal head 8, a recording head of some other type (e.g., an ink jet type or a wire dot type).

The invention claimed is:

1. A printer comprising:

a recording portion having a recording thermal head for performing recording on one side of a recording medium and having a recording platen roller disposed in pressure contact with the recording thermal head for conveying the recording medium;

a thermal activation portion arranged at a position off a conveying course of the recording medium conveyed by the recording platen roller of the recording portion, the thermal activation portion having a thermal activation head configured to heat the other side of the recording medium and having a thermal activation platen roller disposed in pressure contact with the thermal activation head for conveying the recording medium;

a first discharge port provided on a downstream side of the conveying course of the recording medium conveyed by the recording platen roller of the recording portion;

a second discharge port provided on the downstream side of the conveying course of the recording medium conveyed by the thermal activation platen roller of the thermal activation portion;

a pair of conveying rollers arranged between the recording portion and the first discharge port and between the first discharge port and the thermal activation portion, the pair of conveying rollers being configured for conveying the recording medium from the recording portion to the first discharge port through normal rotation of the pair of conveying rollers, for changing the conveying course of the recording medium conveyed from the recording portion, and for conveying the recording medium to the thermal activation portion through reverse rotation of the pair of conveying rollers;

a control device for controlling the pair of conveying rollers such that (1) when the recording medium has on the one side thereof a recording surface on which recording is performed by the recording thermal head and has on the other side thereof a heat-sensitive adhesive layer that is heated by the thermal activation head, the pair of conveying rollers are caused to undergo normal rotation until a trailing end portion of the recording medium reaches the pair of conveying rollers, at which point the pair of conveying rollers are caused to undergo reverse rotation in a state in which the trailing end portion of the recording medium is nipped, and (2) when the recording medium has on the one side thereof a recording surface on which recording is performed by the recording thermal head and has the other side thereof which is not required to be heated by the thermal activation head, the pair of conveying rollers are caused to undergo normal rotation until the recording medium is discharged through the first discharge port; and a temporary stocking portion arranged on a downstream side of the pair of conveying rollers for temporarily retaining the recording medium on the one side on which recording has been performed by the recording thermal head.

2. A printer according to claim 1; wherein the temporary stocking portion temporarily retains the recording medium prior to a conveyance of the recording medium to the thermal activation portion through the reverse rotation of the pair of conveying rollers, and the recording medium discharged through the first discharge port through the normal rotation of the pair of conveying rollers is not introduced into the temporary stocking portion.

3. A printer comprising:

a recording portion having a recording thermal head for performing recording on one side of a recording medium and having a recording platen roller disposed in pressure contact with the recording thermal head for conveying the recording medium;

a thermal activation portion arranged at a position off a conveying course of the recording medium conveyed by the recording platen roller of the recording portion, the thermal activation portion having a thermal activation head configured to heat the other side of the recording medium and having a thermal activation platen roller disposed in pressure contact with the thermal activation head for conveying the recording medium;

a first discharge port provided on a downstream side of the conveying course of the recording medium conveyed by the recording platen roller of the recording portion;

a second discharge port provided on the downstream side of the conveying course of the recording medium conveyed by the thermal activation platen roller of the thermal activation portion;

a pair of conveying rollers arranged between the recording portion and the first discharge port and between the first discharge port and the thermal activation portion, the pair of conveying rollers being configured for conveying the recording medium from the recording portion to the first discharge port through normal rotation of the pair of conveying rollers, for changing the conveying course of the recording medium conveyed from the recording portion, and for conveying the recording medium to the thermal activation portion through reverse rotation of the pair of conveying rollers;

a control device for controlling the pair of conveying rollers such that (1) when the recording medium has on the one side thereof a recording surface on which recording is performed by the recording thermal head and has on the other side thereof a heat-sensitive adhesive layer that is heated by the thermal activation head, the pair of conveying rollers are caused to undergo normal rotation until a trailing end portion of the recording medium reaches the pair of conveying rollers, at which point the pair of conveying rollers are caused to undergo reverse rotation in a state in which the trailing end portion of the recording medium is nipped and (2) when the recording medium has the one side hereof a recording surface on which recording is performed by the recording thermal head and has the other side thereof which is not required to be heated by the thermal activation head, the pair of conveying rollers are caused to undergo normal rotation until the recording medium is discharged through the first discharge port;

a temporary stocking portion for temporarily retaining the recording medium prior to a conveyance of the recording medium to the thermal activation portion through the reverse rotation of the pair of conveying rollers; and a discharge guide for guiding the recording medium discharged through the first discharge port through the normal rotation of the pair of conveying rollers, the temporary stocking portion and the discharge guide being detachably and interchangeably mounted on a downstream side of the pair of conveying rollers.

4. A printer comprising:

a recording portion having a recording thermal head for performing recording on one side a recording medium and having a recording platen roller disposed in pressure contact with the recording thermal head for conveying the recording medium;

a thermal activation portion arranged at a position off a conveying course of the recording medium conveyed by the recording platen roller of the recording portion the thermal activation portion having thermal activation head configured to heat the other side of the recording medium and having a thermal activation platen roller disposed in pressure contact with the thermal activation head for convey the recording medium;

a first discharge port provided on a downstream side of the conveying course of the recording medium conveyed by the recording platen roller of the recording portion;

a second discharge port provided on the downstream side of the conveying course of the recording medium conveyed by the thermal activation platen roller of the thermal activation portion;

a pair of conveying rollers arranged between the recording portion and the first discharge port and between the first discharge port and the thermal activation portion, the pair of conveying rollers being configured for conveying the recording medium from the recording portion to the first discharge port through normal rotation of the pair of conveying rollers for changing the conveying course of the recording medium conveyed from the recording portion, and for conveying the recording medium to the thermal activation portion through reverse rotation of the pair of conveying rollers; and a control device for controlling the pair of conveying rollers such that (1) when the recording medium has on the one side thereof a recording surface on which recording is performed by the recording thermal head and has on the other side thereof a heat-sensitive adhesive layer that is heated by the thermal activation head, the pair of conveying rollers are caused to undergo normal rotation until a trailing end portion of the recording medium reaches the pair of conveying rollers, at which point the pair of conveying rollers are caused to undergo reverse rotation in a state in which the trailing end portion of the recording medium is nipped, and (2) when the recording medium has on the one side thereof a recording surface on which recording is performed by the recording thermal head and has the other side thereof which is not required to be heated by the thermal activation head, the pair of conveying rollers are caused to undergo normal rotation until the recording medium is discharged through the first discharge port;

wherein the thermal activation portion and the second discharge port are provided in a unit detachable with respect to a casing of the printer when the recording medium is discharged through the first discharge port.

5. A printer comprising:

a recording portion having a thermal recording head configured to record on a printing surface of a recording medium and having a first conveying mechanism that conveys the recording medium and is disposed in pressure contact with the thermal head;

a thermal activation portion having a thermal activation head configured to heat a surface of the recording medium opposite the printing surface thereof and having a second conveying mechanism that conveys the recording medium and is disposed in pressure contact with the thermal activation head;

a first discharge port disposed on a downstream side of the first conveying mechanism;

a second discharge port disposed on the downstream side of the second conveying mechanism;

a pair of conveying rollers arranged between the recording portion and the first discharge port and between the first discharge port and the thermal activation portion, the pair of conveying rollers being configured for conveying the recording medium from the recording portion to the first discharge port through normal rotation of the pair of conveying rollers, for changing a conveyance course of the recording medium conveyed from the recording portion, and for conveying the recording medium to the thermal activation portion through reverse rotation of the pair of conveying rollers;

a control device for controlling the pair of conveying rollers such that (1) when the thermal recording head records on the printing surface of the recording medium and the opposite surface of the recording medium has a heat-sensitive adhesive layer that is heated by the thermal activation head, the pair of conveying rollers are caused to undergo normal rotation until a trailing end portion of the recording medium reaches the pair of conveying rollers, at which point the pair of conveying rollers are caused to undergo reverse rotation in a state in which the trailing end portion of the recording medium is nipped, and (2) when the thermal recording head records on the printing surface of the recording medium and the opposite surface of the recording medium is not required to be heated by the thermal activation head, the pair of conveying rollers are caused to undergo normal rotation until the recording medium is discharged through the first discharge port; and a temporary stocking portion disposed between the pair of conveying rollers and the first discharge port for temporarily accommodating the recording medium;

wherein the temporary stocking portion temporarily retains the recording medium prior to a conveyance of the recording medium to the thermal activation portion through the reverse rotation of the pair of conveying rollers; and wherein the recording medium discharged through the first discharge port through the normal rotation of the pair of conveying rollers is not introduced into the temporary stocking portion.

6. A printer comprising:

a recording portion having a thermal recording head configured to record on a printing surface of a recording medium and having a first conveying mechanism that conveys the recording medium and is disposed in pressure contact with the thermal head;

a thermal activation portion having a thermal activation head configured to heat a surface of the recording medium opposite the printing surface thereof and having a second conveying mechanism that conveys the recording medium and is disposed in pressure contact with the thermal activation head;

a first discharge port disposed on a downstream side of the first conveying mechanism;

a second discharge port disposed on the downstream side of the second conveying mechanism;

a pair of conveying rollers arranged between the recording portion and the first discharge port and between the first discharge port and the thermal activation portion, the pair of conveying rollers being configured for conveying the recording medium from the recording portion to the first discharge port through normal rotation of the pair of conveying rollers, for changing a conveyance course of the recording medium conveyed from the recording portion, and for conveying the recording medium to the thermal activation portion through reverse rotation of the pair of conveying rollers;

a control device for controlling the pair of conveying rollers such that (1) when the thermal recording head records on the printing surface of the recording medium and the opposite surface of the recording medium has a heat-sensitive adhesive layer that is heated by the thermal activation head, the pair of conveying rollers are caused to undergo normal rotation until a trailing end portion of the recording medium reaches the pair of conveying rollers, at which point the pair of conveying rollers are caused to undergo reverse rotation in a state in which the trailing end portion of the recording medium is nipped, and (2) when the thermal recording head records on the printing surface of the recording medium and the opposite surface of the recording medium is not required to be heated by the thermal activation head, the pair of conveying rollers are caused to undergo normal rotation until the recording medium is discharged through the first discharge port;

a temporary stocking portion for temporarily retaining the recording medium prior to a conveyance of the recording medium to the thermal activation portion through the reverse rotation of the pair of conveying rollers; and a discharge guide for guiding the recording medium discharged through the first discharge port through the normal rotation of the pair of conveying rollers, the temporary stocking portion and the discharge guide being detachably and interchangeably mounted on a downstream side of the pair of conveying rollers.

7. A printer comprising:

a recording portion having a thermal recording head configured to record on a printing surface of a recording medium and having a first conveying mechanism that conveys the recording medium and is disposed in pressure contact with the thermal head;

a thermal activation portion having a thermal activation head configured to heat a surface of the recording medium opposite the printing surface thereof and having a second conveying mechanism that conveys the recording medium and is disposed in pressure contact with the thermal activation head;

a first discharge port disposed on a downstream side of the first conveying mechanism;

a second discharge port disposed on the downstream side of the second conveying mechanism;

a pair of conveying rollers arranged between the recording portion and the first discharge port and between the first discharge port and the thermal activation portion, the pair of conveying rollers being configured for conveying the recording medium from the recording portion to the first discharge port through normal rotation of the pair of conveying rollers, for changing a conveyance course of the recording medium conveyed from the recording portion, and for conveying the recording medium to the thermal activation portion through reverse rotation of the pair of conveying rollers; and a control device for controlling the pair of conveying rollers such that (1) when the thermal recording head records on the printing surface of the recording medium and the opposite surface of the recording medium has a heat-sensitive adhesive layer that is heated by the thermal activation head, the pair of conveying rollers are caused to undergo normal rotation until a trailing end portion of the recording medium reaches the pair of conveying rollers, at which point the pair of conveying rollers are caused to undergo reverse rotation in a state in which the trailing end portion of the recording medium is nipped, and (2) when the thermal recording head records on the printing surface of the recording medium and the opposite surface of the recording medium is not required to be heated by the thermal activation head, the pair of conveying rollers are caused to undergo normal rotation until the recording medium is discharged through the first discharge port;

wherein the thermal activation portion and the second discharge port are provided in a unit detachable with respect to a casing of the printer; and wherein the unit is detachable from the casing when the recording medium is discharged through the first discharge port.

* * * * *